US009824837B2

(12) United States Patent
Ooishi et al.

(10) Patent No.: US 9,824,837 B2
(45) Date of Patent: Nov. 21, 2017

(54) SERVICE PLUG

(71) Applicant: YAZAKI CORPORATION, Tokyo (JP)

(72) Inventors: Naoya Ooishi, Shizuoka (JP); Yukihisa Kikuchi, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 15/112,935

(22) PCT Filed: Jan. 23, 2015

(86) PCT No.: PCT/JP2015/051908

§ 371 (c)(1),
(2) Date: Jul. 20, 2016

(87) PCT Pub. No.: WO2015/111725

PCT Pub. Date: Jul. 30, 2015

(65) Prior Publication Data

US 2016/0379778 A1 Dec. 29, 2016

(30) Foreign Application Priority Data

Jan. 24, 2014 (JP) ..... 2014-010953

(51) Int. Cl.
*H01H 11/00* (2006.01)
*H01H 65/00* (2006.01)
(Continued)

(52) U.S. Cl.
CPC ..... *H01H 27/00* (2013.01); *H01H 9/26* (2013.01); *H01H 21/04* (2013.01);
(Continued)

(58) Field of Classification Search
CPC ..... H01H 11/00; H01H 65/00; H01H 13/04
(Continued)

(56) References Cited

U.S. PATENT DOCUMENTS 5,075,520 A * 12/1991 Mueller ..... H01H 9/46 218/148
5,859,580 A 1/1999 Hashizawa et al.
(Continued)

FOREIGN PATENT DOCUMENTS

JP 53-157863 12/1978
JP 56-76247 U 6/1981
(Continued)

OTHER PUBLICATIONS

International Search Report and Written Opinion of the International Search Report for PCT/JP2015/051908 dated Mar. 31, 2015.
(Continued)

*Primary Examiner* — Gary Paumen
(74) *Attorney, Agent, or Firm* — Kenealy Vaidya LLP

(57) ABSTRACT

This service plug (1) has a connection terminal part (49), and the connection terminal part (49) has a pair of terminals (8) and an interlinking part (9) that is tailored to the spacing between the terminals (8) and joins the terminals (8) together. By removing the connection terminal part (49) from a power-supply circuit, the power-supply circuit is interrupted. The interlinking part (9) includes one or more thin interlinking plates (20) that are removably attached to the connection terminal part (49).

3 Claims, 9 Drawing Sheets

(51) Int. Cl.

| | |
|---|---|
| ***H01H 27/00*** | (2006.01) |
| ***H01R 13/629*** | (2006.01) |
| ***H01R 31/08*** | (2006.01) |
| ***H01H 9/26*** | (2006.01) |
| ***H01H 21/04*** | (2006.01) |
| ***H01R 13/621*** | (2006.01) |

(52) U.S. Cl.
CPC ... *H01R 13/6215* (2013.01); *H01R 13/62938* (2013.01); *H01R 31/08* (2013.01)

(58) Field of Classification Search
USPC ..... 335/202, 16, 147, 195, 196; 200/275, 200/279; 218/148
See application file for complete search history.

(56) References Cited

U.S. PATENT DOCUMENTS 6,384,702 B1 * 5/2002 Smith ..... H01H 9/46 200/275
7,716,816 B2 * 5/2010 Annis ..... H01H 9/446 218/148
2008/0242150 A1 10/2008 Chikamatsu et al.
2013/0161176 A1 6/2013 Kikuchi et al.

FOREIGN PATENT DOCUMENTS

JP 3-10446 U 1/1991
JP 10-83753 A 3/1998
JP 2003-17198 A 1/2003
JP 2007-250386 A 9/2007
JP 2012-79430 A 4/2012

OTHER PUBLICATIONS

English language Written Opinion of the International Search Report for PCT/JP2015/051908 dated Mar. 31, 2015.
opy of Japanese Office Action for the related Japanese Patent Application No. 2015-559149 dated May 29, 2017. X.

* cited by examiner (a)

(b)

SERVICE PLUG

TECHNICAL FIELD

The present invention relates to a service plug which performs interruption of a power source circuit.

BACKGROUND ART

A power supply such as a battery is provided in a hybrid car, an electric car, etc. in order to drive a motor etc. The power supply such as the battery and the motor etc. are connected to each other by a high-voltage power supply circuit. Accordingly, it is necessary to interrupt the power supply circuit in order to allow a worker to do working safely during an inspection work for the vehicle. To this end, a service plug for interrupting the power supply circuit is provided in the hybrid car, the electric car, etc. For example, the following configuration has been generally known as the configuration of such a service plug. That is, the service plug includes a lever-including housing and a power supply circuit-side housing. In the lever-including housing, a pair of male terminals interlinked to each other by an interlinking part are received inside a housing to which a lever is attached rotatably. The power supply circuit-side housing receives female terminals which are connected to a power supply circuit. A technique corresponding to the service plug having the aforementioned configuration has been disclosed in Patent Literatures 1 through 3.

In FIG. 2 of Patent Literature 1, a switch device 1 is configured as follows. The switch device 1 includes a base material 3, a housing 5, a lever 7, main switches 9*a* and 9*b*, and an interlock switch 11. In FIG. 3 and FIG. 4, the base material 3 is attached to a battery case (not shown) etc. A peripheral wall 17 shaped like a cylinder is provided to protrude upward from a reference surface X. Opening holes 13*a* and 13*b* are formed inside the peripheral wall 17. The housing 5 is formed into a cylindrical shape so that an opening portion can be formed in the housing 5. Cam holes 43 are formed in the level 7. Cam pins 45 provided to protrude from side surfaces of the peripheral wall 17 of the base material 3 are engaged with the cam holes 43. In FIG. 2, the main switches 9*a* and 9*b* are constituted by plate-like male terminals 31*a* and 31*b* which are short-circuited, and female terminals 33*a* and 33*b* into which the male terminals 31*a* and 31*b* are inserted. The male terminals 31*a* and 31*b* are internally fixed to the housing 5. The female terminals 33*a* and 33*b* are internally fixed to the opening holes 13*a* and 13*b* of the base material 3. One of the female terminals 33*a* and 33*b* is connected to a battery side of a power supply circuit while the other opening hole 33*a* or 33*b* is connected to a load side of a motor etc. of the power supply circuit.

In the switch device 1, when the lever 7 is pushed down to be locked to lock protrusions 49, male terminals are inserted into their corresponding female terminals in the main switches 9*a* and 9*b* and the interlock switch 11. To interrupt the power supply circuit during an inspection work for the motor etc., the lever 7 is unlocked and then rotated into a state where the lever 7 can stand up as shown in FIG. 2. In this manner, the interlock switch 11 is cut off. Then, the main switches 9*a* and 9*b* are cut off as soon as the housing 5 is removed from the base material 3. On the other hand, after the inspection work, the male terminals 31*a* and 31*b* on the housing 5 side are inserted into the female terminals 33*a* and 33*b* on the base material 3 side. Then, when the lever 7 is rotated in a direction to fall down, the housing 5 and the base material 3 move in a direction to approach each other.

When the lever 7 is further rotated, lock holes 51 of the lever 7 are engaged with the lock protrusions. In this manner, the main switches 9*a* and 9*b* and the interlock switch 11 are connected.

In FIG. 1 and FIG. 2 of Patent Literature 2, a power supply circuit interrupting device 1 is provided with a plug body 2, a lever 3, and a circuit receiving body 4. The plug body 2 serves as one connector housing. The lever 3 is attached to the plug body 2. The circuit receiving body 4 serves as the other connector housing into which the plug body 2 can be fitted by a lever operation. The plug body 2 is provided with a body housing 5 and a fuse 6 which is pressed and mounted into the body housing 5. The fuse 6 is provided with a cylindrical housing 61, a fusible element (not shown) which is received inside the housing 61, and a pair of terminals 62. The pair of terminals 62 are made of electrically conductive metal plates. One end portions of the terminals 62 are received inside the housing 61 so as to be connected to the fusible element. In FIG. 4, the circuit receiving body 4 is provided with a body housing 41 and a pair of circuit terminals 42 which are received inside the body housing 41. One of the circuit terminals 42 is connected to a terminal of an electric wire 43*a* connected to a battery while the other circuit terminal 42 is connected to a terminal of an electric wire 43*b* connected to a load serving as an electronic device.

In the power supply circuit interrupting device 1, when the lever 3 brought into a standing-up state is rotated in a direction to fall down in order to fit the plug body 2 into the circuit receiving body 4 as shown in FIG. 1 of Patent Literature 2, the pair of terminals 62 of the plug body 2 are connected to the pair of circuit terminals 42. In this manner, the electric wires 43*a* and 43*b* connected to the pair of circuit terminals are connected through the fuse 6. When an overcurrent flows into the fuse 6, the fusible element blows out to disconnect the pair of terminals 62. Thus, the power supply circuit is interrupted. During an inspection work, the lever 3 in the state shown in FIG. 1 is rotated in a direction to stand up to thereby separate the plug body 2 from the circuit receiving body 4. In this manner, conduction between the pair of terminals 62 of the plug body 2 and the electric wires 43*a* and 43*b* connected to the pair of circuit terminals 42 respectively is opened so that the power supply circuit is interrupted.

In FIG. 1 of Patent Literature 3, a service plug 1 includes a circuit receiving body 10, and a plug body 41 which can be removably attached to the circuit receiving body. The circuit receiving body 10 receives a pair of circuit terminals 35. Electric wires 19 are connected to rear parts of the circuit terminals 35 respectively while the circuit terminals 35 are spaced at a predetermined distance from each other. Thus, an open electric circuit is formed. A cylindrical fuse 54 is retained in the plug body 41. The plug body 41 is provided with a pair of male terminals 45 which can be engaged with circuit terminals (female terminals) 35. In addition, a lever 59 is provided in an upper surface of the plug body 41 so as to be interlinked rotatably thereto. In FIG. 4, fuse terminals 57 each formed into a plate shape are provided to protrude from opposite ends of the cylindrical fuse 54. Through holes 58 for inserting the male terminals 45 therein are formed in the fuse terminals 57. The male terminals 45 are inserted into the through holes 58 and bolts 51 are screwed on threaded parts 45*a* formed in the male terminals 45. Thus, the fuse terminals 57 and the male terminals 45 are engaged with each other.

In the service plug 1, when the plug body 41 is inserted into a reception space 27 in the circuit receiving body 10, the male terminals 45 are inserted into the female terminals 35. In this manner, the electric wires connected to the pair of female terminals 35 are conductively connected through the fuse to form an electric circuit. On the other hand, during an inspection work for the electric circuit, the plug body 41 is pulled upward to be thereby extracted from the circuit container 10. Conduction between the electric wires 19 connected to the pair of female terminals 35 is made open. Thus, the electric circuit is interrupted.

CITATION LIST

Patent Literature

Patent Literature 1: JP-A-2012-79430
Patent Literature 2: JP-A-2007-250386
Patent Literature 3: JP-A-10-83753

SUMMARY OF INVENTION

Technical Problem

The current-carrying capacity of the service plug and the distance between the terminals vary largely from one another according to the difference in the kind of the vehicle. In such background-art techniques, when the current value of the power supply circuit increases due to the difference in the kind of the vehicle, the current-carrying capacity of each plate-like terminal component conductively connecting the power supply circuit has to be increased but there is a problem that the plate-like terminal component cannot support the change of the current value easily. In addition, as a solution to the aforementioned problem, the plate thickness or width of the terminal component has to be increased or another component has to be provided newly. Therefore, there is a problem that the manufacturing cost increases accordingly.

The invention has been accomplished in consideration of the aforementioned circumstances. An object of the invention is to provide a service plug whose current-carrying capacity can be changed easily in accordance with a change in a current value.

Solution to Problem

The service plug according to the invention which has been accomplished in order to solve the foregoing problems is a service plug for interrupting a power supply circuit by removing a connection terminal part from the power supply circuit, the service plug including: the connection terminal part that comprises a pair of terminals and an interlinking part. The pair of terminals are disposed to be spaced at a predetermined distance therebetween. The interlinking part that is formed so as match with the distance between the pair of terminals to interlink the terminals to each other. The interlinking part is formed from one interlinking plate or a plurality of interlinking plates each shaped into a thin plate. The interlinking plate or the interlinking plates are attached to the connection terminal part removably.

According to the invention having such characteristic, one interlinking plate or a plurality of interlinking plates can be attached to the connection terminal part removably.

In addition, the service plug according to the invention is the aforementioned service plug in which the one interlinking plate or the plurality of interlinking plates are attached to the pair of terminals removably.

According to the invention having such characteristic, the interlinking part of the connection terminal part is formed in such a manner that the one interlinking plate or the plurality of interlinking plates are attached to the pair of terminals removably.

In addition, the service plug according to the invention is the aforementioned service plug in which bolt fastening holes for inserting bolts therein are formed in the interlinking plate or each of the interlinking plates, and fastening parts for fastening the interlinking plate or the interlinking plates are formed in the pair of terminals.

According to the invention having such characteristic, the bolt fastening holes for inserting bolts therein are formed in the interlinking plate or each of the interlinking plates. In addition, the fastening parts for fastening the interlinking plate or the interlinking plates are formed in the pair of terminals.

Advantageous Effects of Invention

According to the invention, a plurality of interlinking plates are piled up on one another. Due to the configuration, current-carrying capacity of a connection terminal part can be changed easily by an increase/decrease of the quantity of the interlinking plates.

DESCRIPTION OF EMBODIMENT

Example of a service plug according to the invention will be described below with reference to FIG. 1 to FIG. 9.

Figure 1:
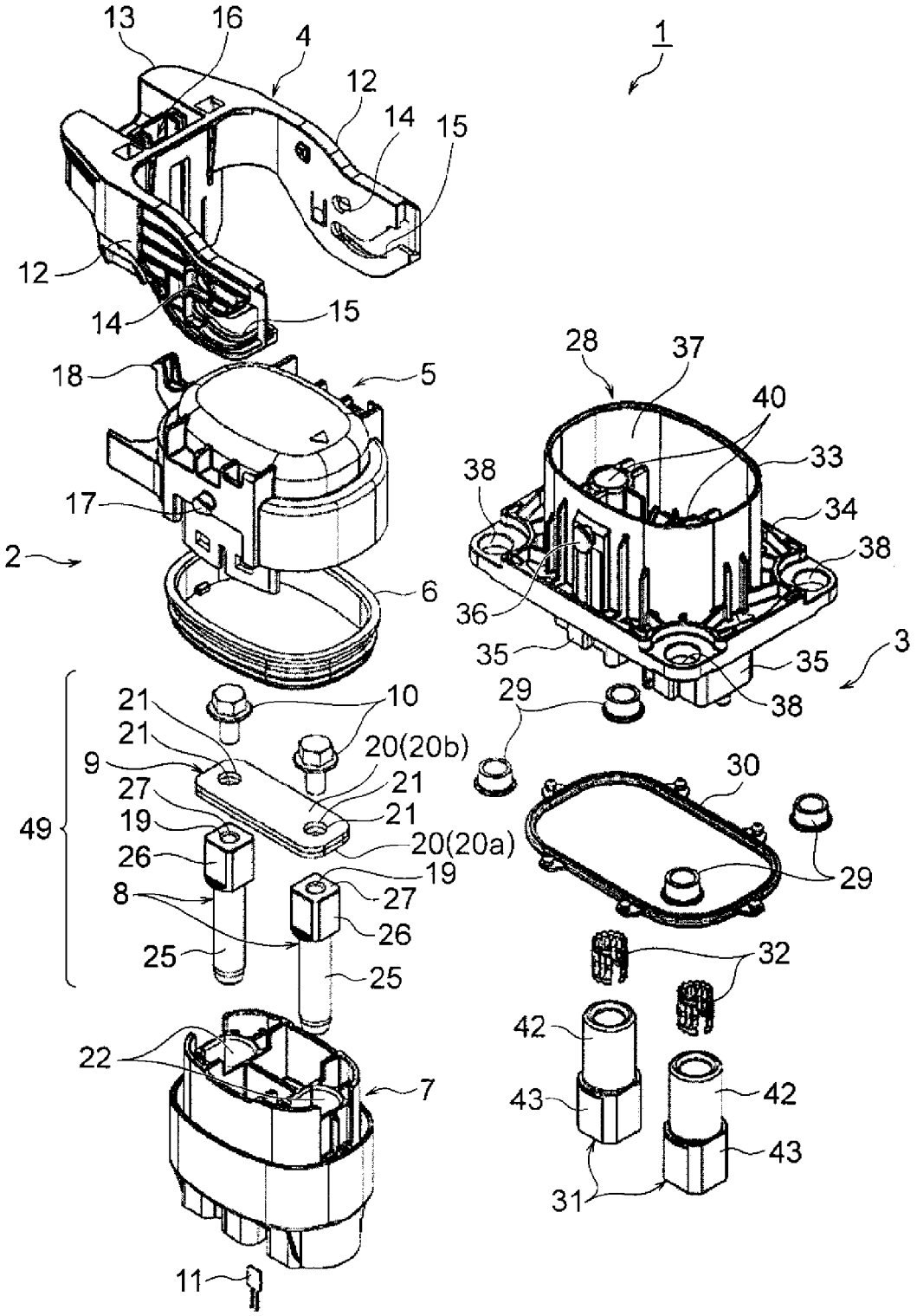
FIG. 1 is a development perspective view showing an embodiment of a service plug according to the invention.
Figure 2:
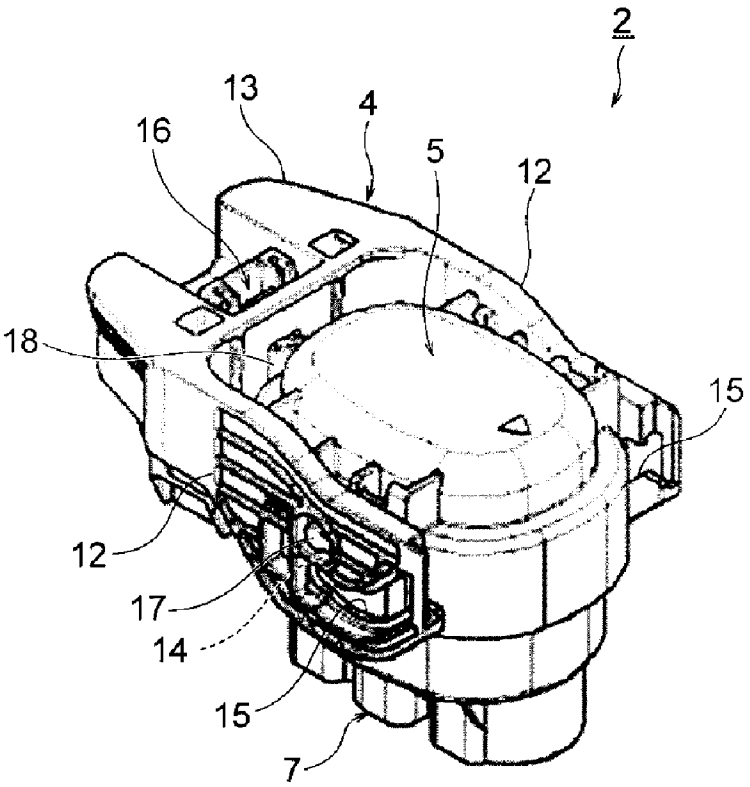
FIG. 2(*a*) and FIG. 2(*b*) are perspective views of a lever-including housing.
Figure 2:
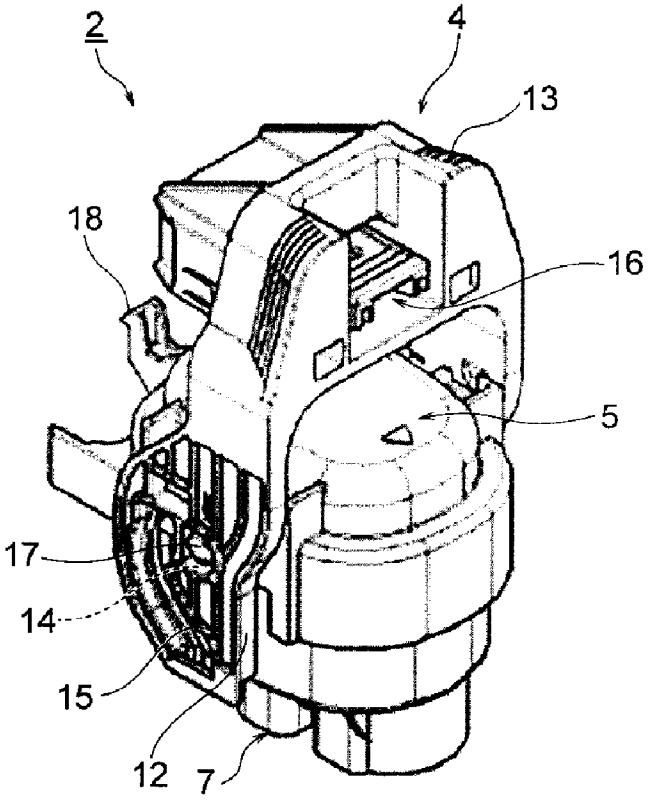
Figure 3:
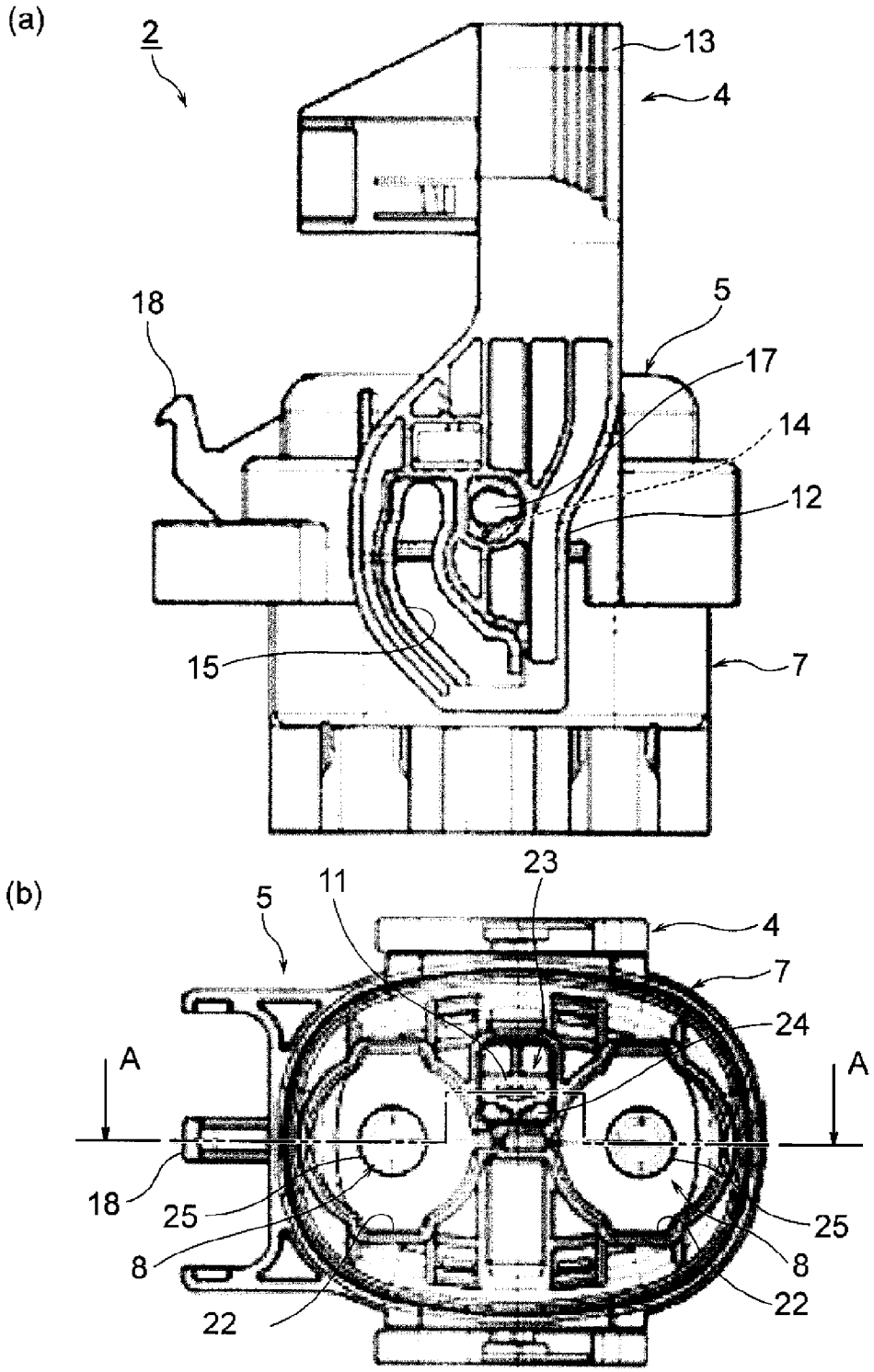
FIG. 3(*a*) and FIG. 3(*b*) are a side view and a bottom view of the lever-including housing in FIG. 2(*a*) and FIG. 2(*b*).
Figure 4:
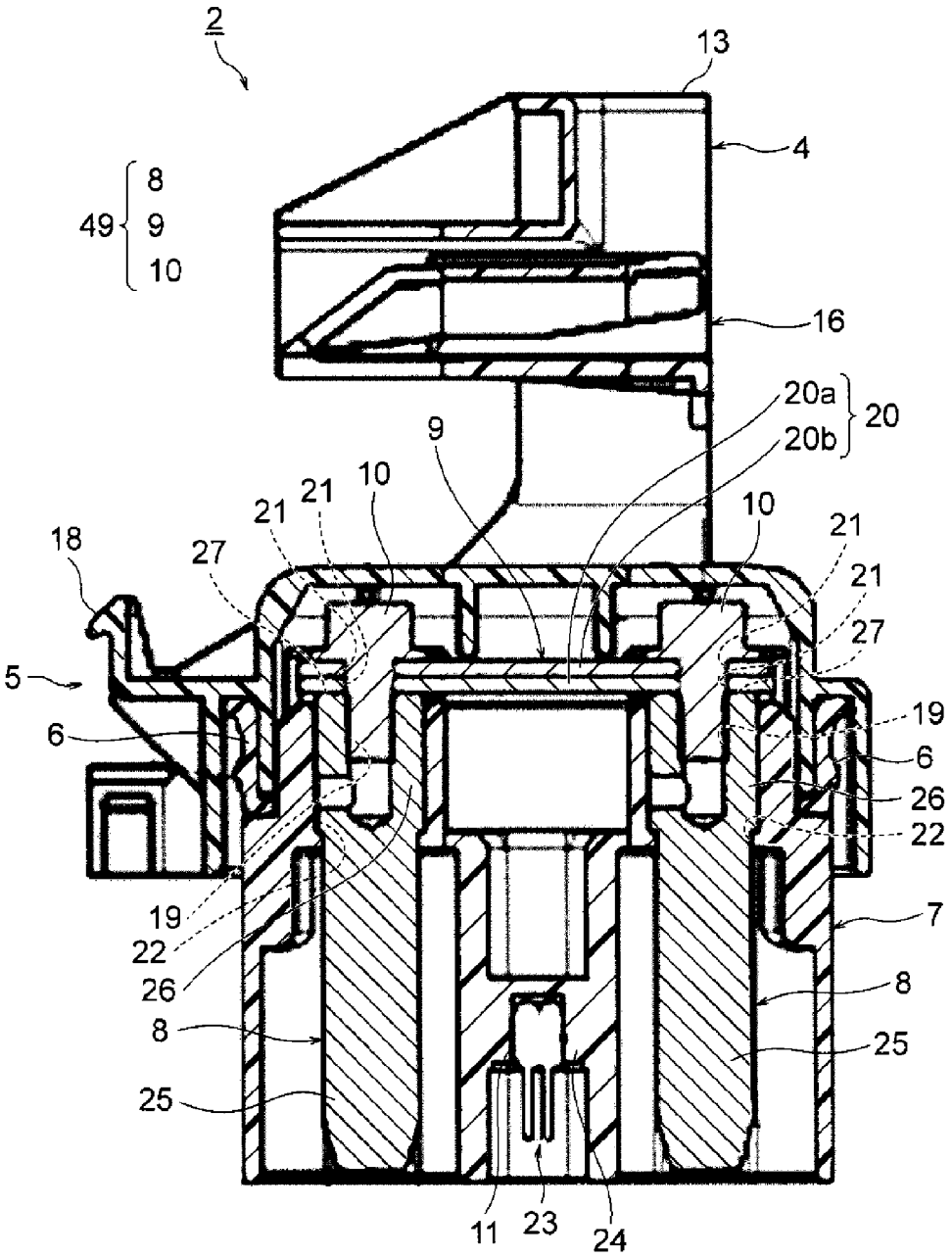
FIG. 4 is a sectional view of the lever-including housing.
Figure 5:
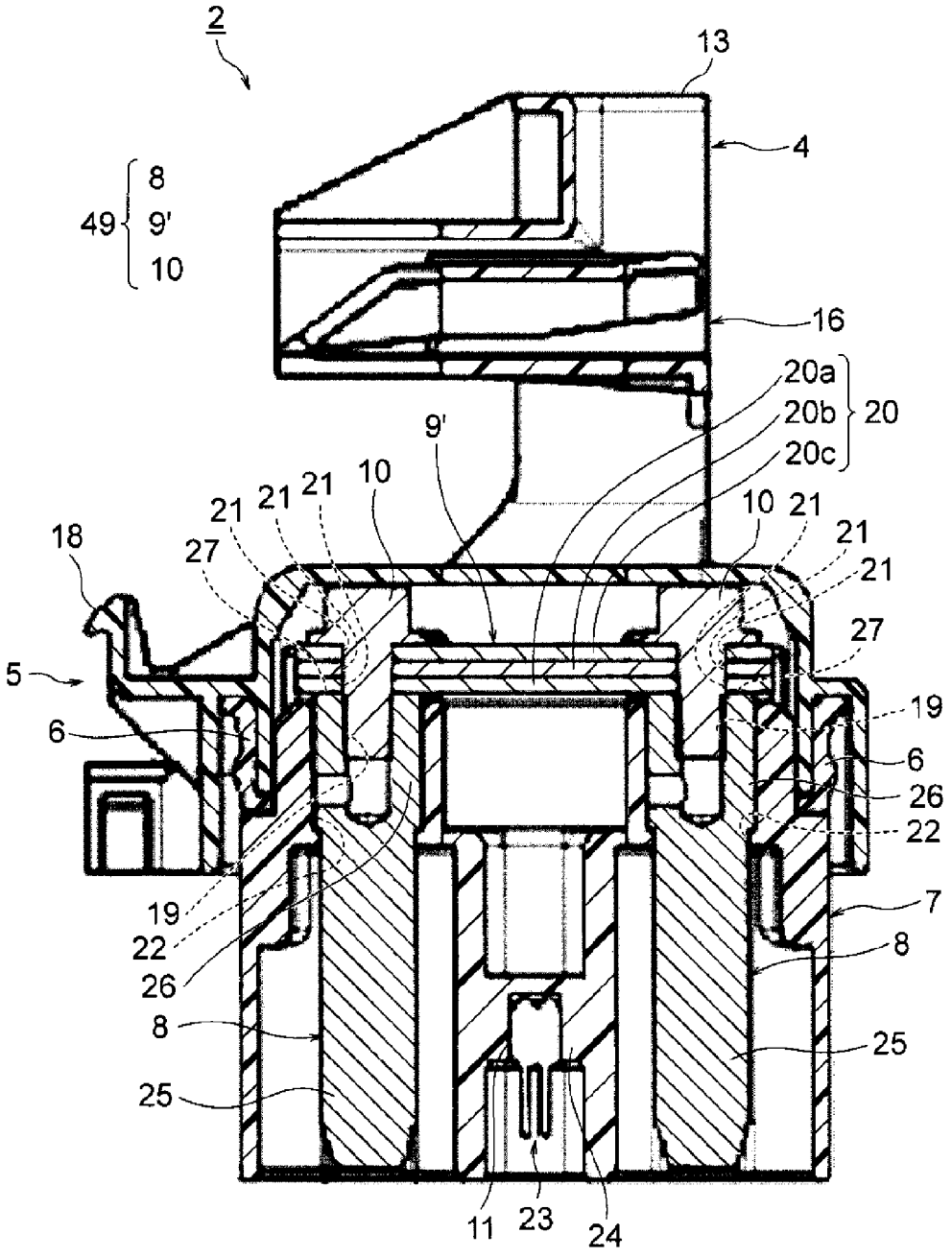
FIG. 5 is a sectional view of a lever-including housing in a modification of the service plug according to the invention.
Figure 6:
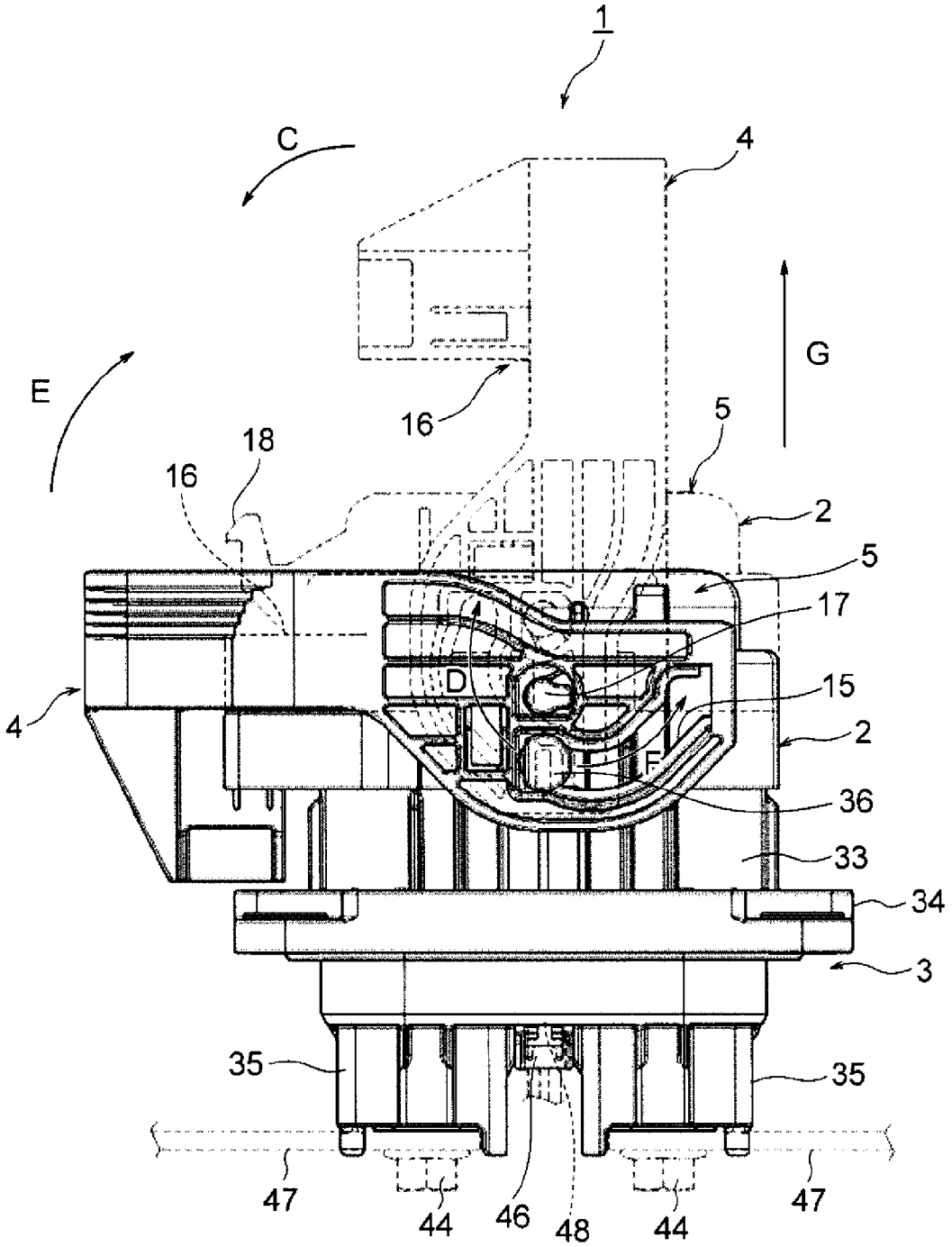
FIG. 6 is an explanatory view of a fitting work of the service plug.
Figure 7:
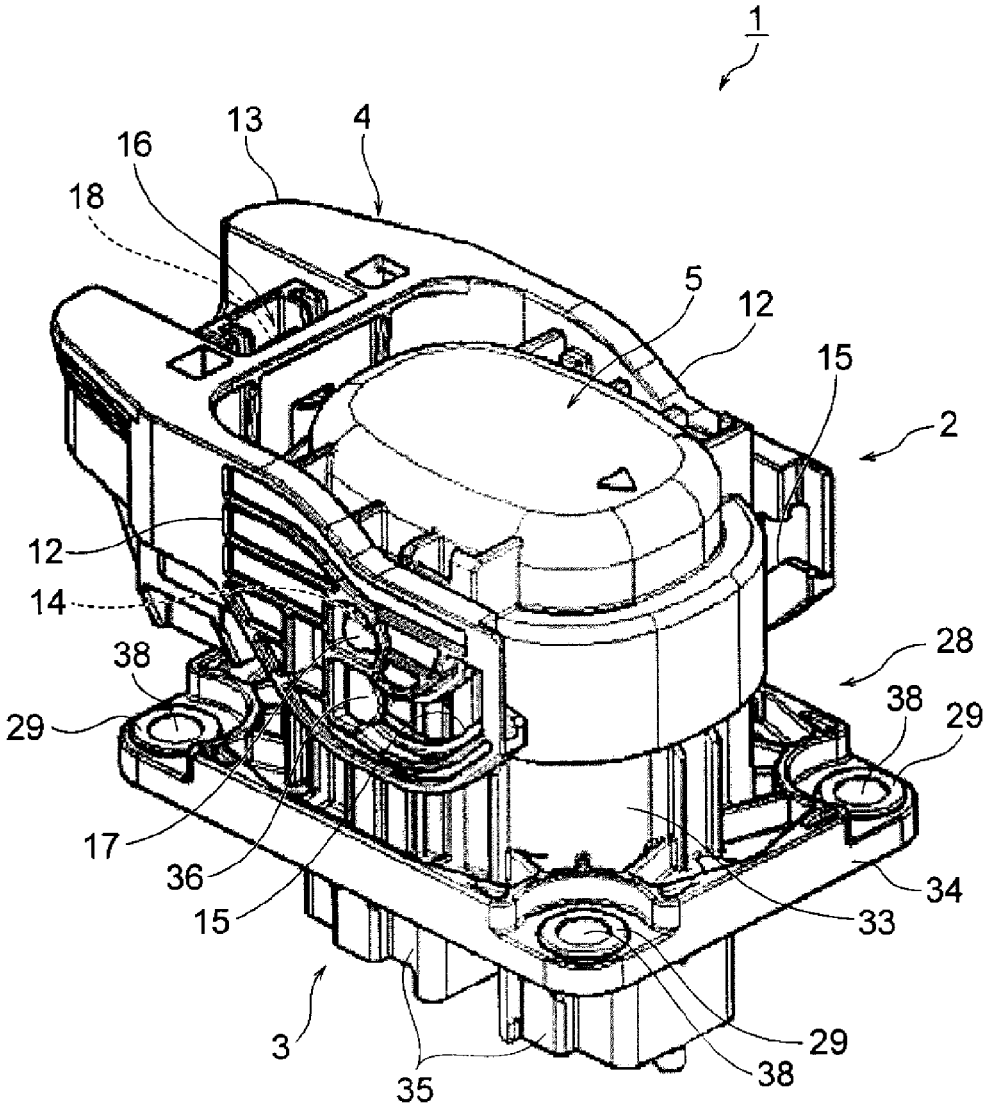
FIG. 7 is a perspective view of the service plug after the fitting.
Figure 8:
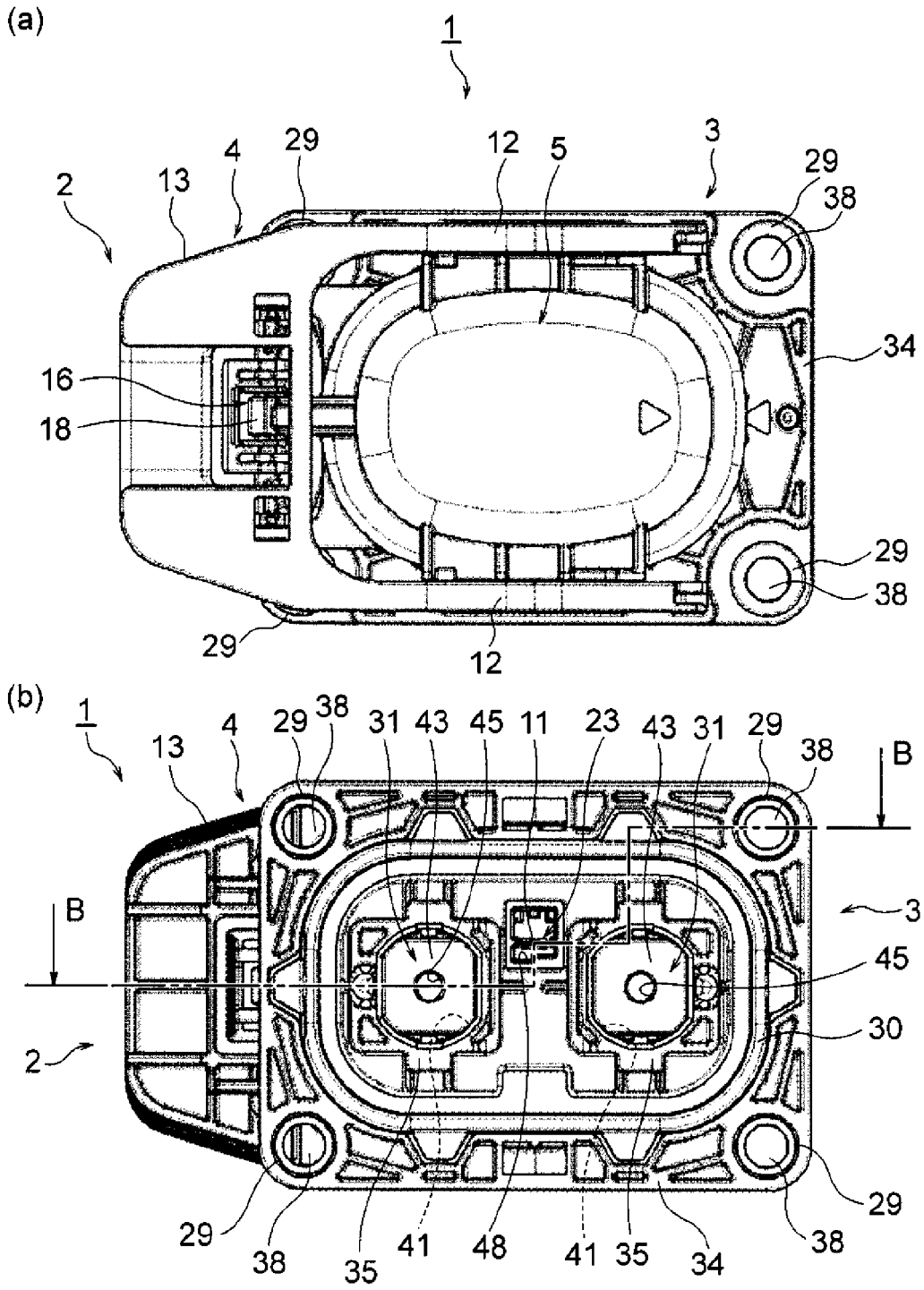
FIG. 8(*a*) and FIG. 8(*b*) are a plan view and a bottom view of the service plug after the fitting.
Figure 9:
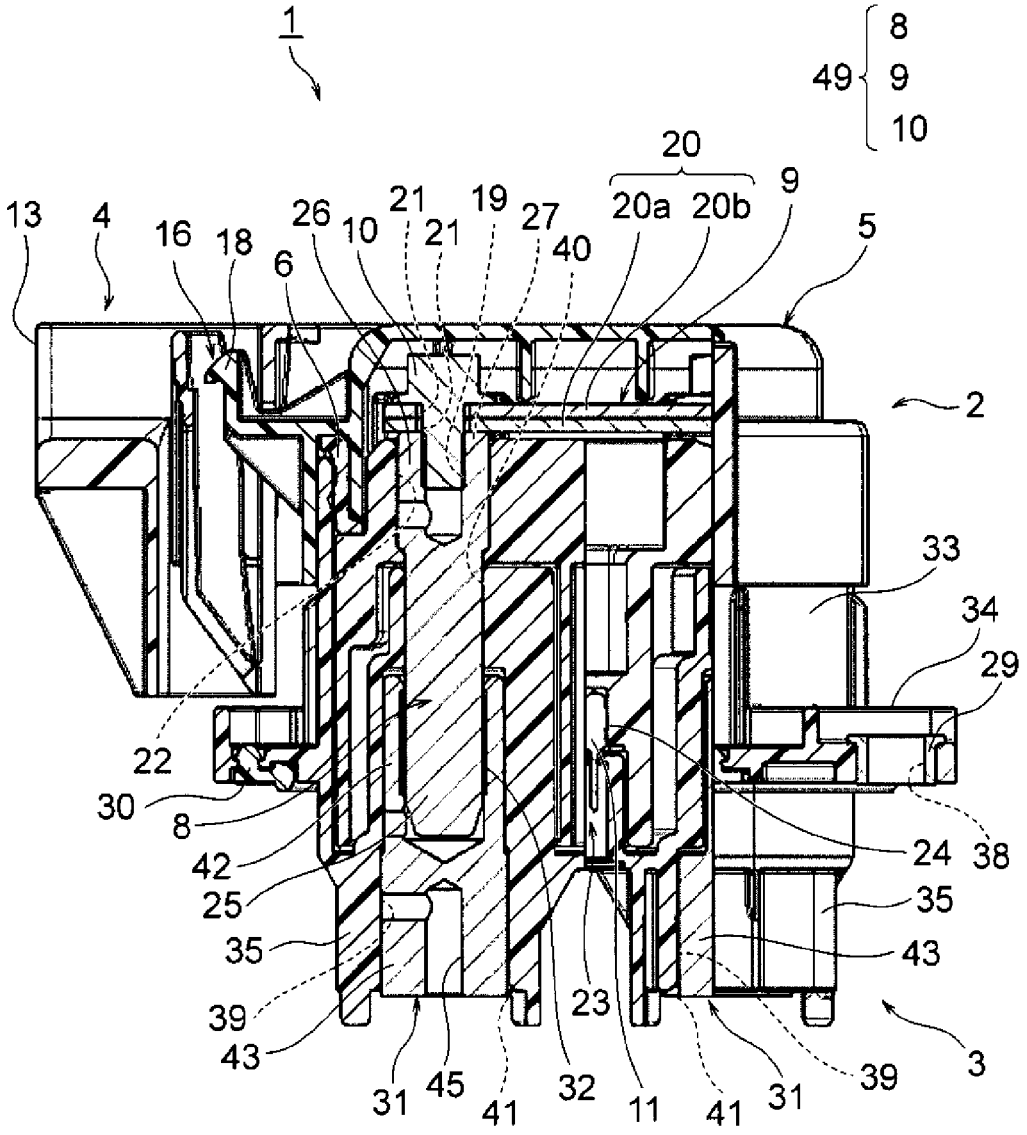
FIG. 9 is a sectional view of the service plug after the fitting.

FIG. 1 is a development perspective view showing an embodiment of the service plug according to the invention of the invention. FIG. 2(*a*) is a perspective view of a lever-including housing in which a lever has been pushed down. FIG. 2(*b*) is a perspective view of the lever-including housing in which the lever has stood up. FIG. 3(*a*) is a side view of FIG. 2(*b*). FIG. 3(*b*) is a bottom view of FIG. 3(*a*). FIG. 4 is a sectional view taken along a line A-A in FIG. 3(*b*). FIG. 5 is a sectional view of a part corresponding to that taken along the line A-A in FIG. 3(*b*), of a lever-including housing in a modification of the service plug according to the invention. FIG. 6 is an explanatory view of a fitting work of the service plug. FIG. 7 is a perspective view of the service plug after the fitting. FIG. 8(*a*) is a plan view of the service plug in FIG. 7. FIG. 8(*b*) is a bottom view of the service plug in FIG. 7. FIG. 9 is a sectional view taken along a line B-B in FIG. 8(*b*).

In FIG. 1, the reference sign 1 designates a service plug. The service plug 1 in the Example is, for example, mounted in a vehicle (such as a hybrid car, an electric car etc., although not shown). The service plug 1 is provided to interrupt a power supply circuit making connection between a motor driving the vehicle and a battery feeding electric power to the motor. The service plug 1 in the Example is attached to a battery case (not shown) (This is regarded as one of examples. The service plug 1 does not have to be limited to the one attached to the battery case as long as it can interrupt the power supply circuit. In addition, the service plug 1 is not limited to the one mounted in the vehicle.).

The service plug 1 is configured to include a lever-including housing 2 and a power supply circuit-side housing 3.

In FIGS. 1 to 4, the lever-including housing 2 is configured to include a lever 4, a packing 6, a housing body 7, and a connection terminal part 49.

The lever 4 is made of an insulating synthetic resin. The lever 4 includes a pair of arm parts 12 and a gripping part 13. Rotary shaft holes 14 and cam holes 15 are formed in the pair of arm parts 12. The rotary shaft holes 14 are formed as through holes into which rotary shafts 17 which will be described later can be inserted and fitted. The cam holes 15 are formed as long holes each of which is formed substantially into an arc shape and with which cam shafts 36 which will be described later can be engaged. The gripping part 13 is formed to interlink the pair of arm parts 12 to each other. A lever-side engagement part 16 is provided in the gripping part 13.

A cover 5 is made of an insulating synthetic resin. The cover 5 is formed to be able to be fitted onto the housing body 7. The pair of rotary shafts 17 and a cover-side engagement part 18 are provided in the cover 5. The pair of rotary shafts 17 are provided protrusively from side surfaces of the cover 5 and provided as parts which are inserted into the rotary shaft holes 14 of the lever 4 to be engaged therewith. As shown in FIG. 2(*a*), the cover-side engagement part 18 is provided to be able to be engaged with the lever-side engagement part 16 in a state in which the lever 4 has been pushed down.

In FIG. 1, the housing body 7 is made of an insulating synthetic resin and formed substantially into a cylindrical shape. The housing body 7 is configured as follows. Male terminal receiving chambers 22 and a fitting detection male connector 23 (see FIG. 3(*b*)) are internally provided in the housing body 7. The male terminal receiving chambers 22 are internally formed in wall parts each formed substantially into a cylindrical shape. Male terminals 8 are received and retained in the male terminal receiving chambers 22. In FIG. 3(*b*) and FIG. 4, the fitting detection male connector 23 is provided substantially in the center of a lower surface of the housing body 7. The fitting detection male connector 23 is configured to include a fitting detection male terminal 11 and a fitting detection male terminal receiving part 24. The fitting detection male terminal 11 is formed as an electrically conductive metal plate notched into a predetermined shape. The fitting detection male terminal receiving part 24 is formed so that the fitting detection male terminal 11 can be fitted and retained therein.

The packing 6 is made of a synthetic resin and formed substantially into a circular ring shape. As shown in FIG. 4, the packing 6 is formed to be able to be fitted between the cover 5 and the housing body 7. The packing 6 is provided to be able to prevent water from entering the inside of the lever-including housing 2.

In FIG. 1, the connection terminal part 49 is provided with the pair of male terminals 8, an interlinking part 9, and a pair of bolts 10.

The pair of male terminals 8 (the pair of male terminals 8 correspond to "one pair of terminals" in the scope of claims of the invention) are made of electrically conductive metal. Each of the male terminals 8 is configured to include a shaft part 25 and a head part 26 (the head part 26 corresponds to "fastening part" in the scope of claims of the invention). The shaft part 25 is formed substantially into a circularly columnar shape and the head part 26 is formed substantially into a rectangular parallelepiped shape (the shapes are regarded as ones of examples). The head part 26 is formed to have a diameter larger than the diameter of thickness of the shaft part 25. Bolt threaded holes 19 are formed in upper surfaces 27 of the head parts 26 so that the pair of bolts 10 can be screwed into the bolt threaded holes 19 respectively. Thus, the pair of bolts 10 are threadedly engaged with the pair of bolt threaded holes 19.

The interlinking part 9 is formed out of interlinking plates 20 which are made of electrically conductive metal. The interlinking plates 20 are configured to consist of two interlinking plates 20*a* and 20*b* (the number of the interlinking plates 20 is not limited to two. As will be described later, the number of the interlinking plates 20 to be provided may be more than two). The two interlinking plates 20*a* and 20*b* are formed separately. As shown in FIG. 4, the two interlinking plates 20*a* and 20*b* which have been piled up on each other are mounted on the upper surfaces 27 of the head parts 26 of the pair of the male terminals 8.

In the Example, the interlinking part 9 is formed out of the two interlinking plates 20*a* and 20*b* piled up on each other. However, configuration may be alternatively made so that three interlinking plates 20 are provided, for example, as shown in an interlinking part 9' in FIG. 5. In the interlinking part 9', three interlinking plates 20*a*, 20*b* and 20*c* piled up on one another are mounted on the upper surfaces 27 of the head parts 26 of the pair of male terminals 8 (incidentally, the number of the interlinking plates 20 is not limited to be plural but may be one).

Each of the interlinking plates 20 is formed into a thin plate shape. The interlinking plate 20 is formed into a belt plate shape having a size large enough to entirely cover the upper shapes 27 of the head parts 26 in the pair of male terminals 8 which are received in the male terminal receiving chambers 22 of the housing body 7. That is, the interlinking plate 20 is formed in accordance with the distance between the pair of male terminals 8 received in the male terminal receiving chambers 22.

Bolt fastening holes 21 are formed to penetrate the vicinities of longitudinally opposite end portions of the belt plate shape of each of the interlinking plates 20 respectively. The bolts 10 are formed to be able to be inserted into the bolt fastening holes 21 respectively. The bolt fastening holes 21 are formed to be aligned with the formation positions of the bolt threaded holes 19 when the interlinking plates 20 are placed on the upper surfaces 27 of the head parts 26 in the pair of male terminals 8 which are received in the male terminal receiving chambers 22 of the housing body 7. When the distance between the male terminals 8 is changed, the bolt fastening holes 21 can be formed in accordance with the distance between the male terminals 8.

The pair of bolts 10 are provided to be fastened to the head parts 26 of the pair of terminals in the state in which the interlinking plates 20*a* and 20*b* are piled up on each other. The pair of bolts 10 are formed so that shaft parts of the bolts 10 can be inserted into the bolt fastening holes 21*a* and 21*b* of the interlinking plates 20*a* and 20*b* and threadedly engaged with the bolt threaded holes 19 formed in the upper surfaces 27 of the head parts 26 of the pair of male terminals 8.

Due to the configuration made thus, the male terminals 8 are interlinked to each other in use by one interlinking plate 20 according to the connection terminal part 49. Accordingly, when the current value of the power supply circuit has increased, another interlinking plate 20 can be piled up additionally, as shown in FIG. 4. When another interlinking plate 20 is piled up additionally thus, the current-carrying capacity can be made larger, and adjusted in accordance with the change of the current-carrying capacity required of the connection terminal part 49. Further, even when the current value has become larger, three interlinking plates 20 can be piled up on one another as shown in FIG. 5. Thus, the current-carrying capacity can be increased, and adjusted in accordance with the change of the current-carrying capacity required of the connection terminal part 49.

In addition, even when the distance between the male terminals 8 is changed, each interlinking plate 20 in use can be replaced by another interlinking plate 20 having a size conforming to the distance between the male terminals 8. Thus, it is possible to deal with the change of the distance between the male terminals 8.

In addition, according to the connection terminal part 49 configured as described above, the bolt fastening holes 21 are formed in each thin plate-like interlinking plate 20. Due to the configuration, the bolt fastening holes 21 can be formed easily as through holes formed in the thin plate-like interlinking plate 20.

In addition, the head parts 26 of the male terminals 8 function as fastening parts for fastening the interlinking plate 20 to the male terminals 8. It is possible to form the interlinking part 9 in which the male terminals 8 are connected to each other when the interlinking plates 20 are attached to the upper surfaces 27 of the head parts 26.

Incidentally, according to the configuration in the Example, one interlinking plate 20 or a plurality of interlinking plates 20 are attached to one pair of male terminals 8 removably. However, the configuration is not limited thereto. That is, as long as the interlinking plate 20 or the interlinking plates 20 can be attached to the connection terminal part 49 removably, it or they may be attached indirectly to the male terminals 8 per se.

Next, the power supply circuit-side housing 3 will be described.

In FIG. 1, the power supply circuit-side housing 3 is configured to include a housing body 28, collars 29, a packing 30, a pair of female terminals 31, and contact members 32.

The housing body 28 is made of an insulating synthetic resin. The housing body 28 is configured to include a peripheral wall 33, an attachment part 34, and female terminal receiving parts 35.

The peripheral wall 33 is formed substantially into a cylindrical shape. A pair of cam shafts 36 are provided to protrude from side surfaces of the peripheral wall 33. The cam shafts 36 are formed to be engaged with the cam holes 15 of the lever 4 so that the cam shafts 36 can be slid inside the cam holes 15 by rotation of the lever 4. An upper surface of the peripheral wall 33 is formed as an opening portion 37 which is formed as an opening continuously to the inner side of the peripheral wall 33.

The attachment part 34 is formed substantially into a rectangular flange shape continuously to the peripheral wall 33. Through holes 38 are formed to penetrate the attachment part 34 at four corners. In FIG. 8(*b*), a fitting detection female connector inserting hole 48 formed substantially into a rectangular shape substantially in the center of the lower surface of the attachment part 34 is formed in the attachment part 34. The fitting detection female connector inserting hole 48 is formed so that a fitting detection female connector 46 can be inserted and retained therein, as designated by a broken line in FIG. 6. Incidentally, the fitting detection female connector 46 is a member which is fitted into the fitting detection male connector 23 in the lever-including housing 2 to be connected to a signal circuit.

The female terminal receiving parts 35 are provided continuously to the attachment part 34 so as to protrude from the lower side of the housing body 28. Of each of the female terminal receiving parts 35, a portion exposed to the outside of the housing body 28 is formed substantially into a box shape. In addition, of each of the female terminal receiving parts 35, a portion which is provided on the inner side of the peripheral wall 33 is formed substantially into a cylindrical shape. In FIG. 9, female terminal receiving chambers 39 in which the female terminals 31 are received and retained internally are formed in the female terminal receiving parts 35. Male terminal inserting holes 40 into which the male terminals 8 can be inserted are formed in upper ends of the female terminal receiving parts 35. Female terminal inserting holes 41 into which the female terminals 31 can be inserted are formed in lower ends of the female terminal receiving parts 35. The male terminal inserting holes 40 and the female terminal inserting holes 41 are formed continuously to the female terminal receiving chambers 39.

In FIG. 1, each of the collars 29 is made of metal and formed substantially into a cylindrical shape. The collars 29 are formed to be able to be inserted into the through holes 38 of the attachment part 34. The inner diameter of each of the collars 29 is formed so that a bolt (not shown) for attaching the power supply circuit-side housing 3 to the battery case can be inserted into the collar 29.

In addition, the packing 30 is made of a synthetic resin and formed substantially into a circular ring shape. As shown in FIG. 8(*b*) and FIG. 9, the packing 30 is formed to be able to be mounted on the lower side of the attachment part 34.

In FIG. 1, the pair of female terminals 31 are made of electrically conductive metal. Each of the female terminals 31 is constituted to include an electric contact part 42 and an electric connection part 43. The electric contact part 42 is formed substantially into a cylindrical shape. As shown in FIG. 9, the shaft parts 25 of the male terminals 8 can be internally inserted in the electric contact parts 42. The electric connection parts 43 are formed as parts which are electrically connected to the power supply circuit. In FIG. 1, each of the electric connection parts 43 is formed substantially into a box shape, and bolt threaded holes 45 with which bolts 44 (see FIG. 6) can be threadedly engaged are formed in lower surfaces of the electric connection parts 43.

In addition, the contact members 32 are provided for making conductivity between the male terminals 8 and the female terminals 31 excellent. The contact members 32 are made of electrically conductive metal and formed so that the contact members 32 can be internally inserted in the pair of female terminals 31.

Here, a fitting work between the lever-including housing 2 and the power supply circuit-side housing 3 will be described.

First, in the state in which the lever 4 of the lever-including housing 2 has been pulled to stand up as shown in FIG. 2(*b*), the lever-including housing 2 is inserted from the housing body 7 side into the opening portion 37 of the power supply circuit-side housing 3 in FIG. 1. In this manner, the lever-including housing 2 is placed in a state before the start of fitting into the power supply circuit-side housing 3, as designated as a broken line in FIG. 6.

In the state in FIG. 6, the lever 4 is rotated in a direction of an arrow C. When the rotation of the lever 4 is started, the cam holes 15 and the cam shafts 36 are engaged with each other respectively. Further, when the rotation of the lever 4 is continued, the cam shafts 36 are pressed to slide inside the cam holes 15 in accordance with the rotation of the lever 4. The cam shafts 36 moves inside the cam holes 15 in a direction of an arrow D in accordance with the rotation of the lever 4. In this manner, the distances between the rotary shafts 17 and the cam shafts 36 are shortened so that the lever-including housing 2 and the power supply circuit-side housing 3 can approach each other. In this manner, the pair of male terminals 8 (see FIG. 1 and FIGS. 3(*a*) and 3(*b*)) are inserted into the pair of female terminals 31 (see FIG. 1). In addition, fitting between the fitting detection male connector 23 and the fitting detection female connector 46 is started after insertion of the pair of male terminals 8 into the pair of female terminals 31 starts.

When the lever 4 which has been pulled to stand up is rotated in the direction of the arrow C substantially by 90°, the lever-side engagement part 16 and the cover-side engagement part 18 are engaged with each other. In this manner, the lever-including housing 2 designated by a solid line in FIG. 6 is completely fitted into the power supply circuit-side housing 3.

When the lever-including housing 2 and the power supply circuit-side housing 3 are completely fitted into each other in FIG. 7 and FIGS. 8(*a*) and 8(*b*), the pair of male terminals 8 and the pair of female terminals 31 are electrically connected to each other respectively as shown in FIG. 9. The pair of male terminals 8 are interlinked to each other by the interlinking part 9 (the interlinking plates 20*a* and 20*b*). Due to the configuration, conduction between the male terminals 8 can be attained. Although not shown in FIG. 9, a pair of bus bars 47 (see FIG. 6) forming the power supply circuit are fastened to the electric connection parts 43 of the female terminals 31 by the bolts 44 (see FIG. 6). Accordingly, the power supply circuit can be electrically connected by the connection between the pair of male terminals 8 and the pair of female terminals 31.

Successively, a work for operating the service plug 1 to therefore interrupt the power supply circuit will be described.

When the lever 4 designated by a solid line is rotated in a direction of an arrow E in FIG. 6, the cam shafts 36 move inside the cam holes 15 in a direction of an arrow F in accordance with the rotation of the lever 4. In this manner, the distances between the rotary shafts 17 and the cam shafts 36 are widened so that the lever-including housing 2 can be separated from the power supply circuit-side housing 3. Then, the lever-including housing 2 is pulled up in a direction of an arrow G to be removed from the power supply circuit-side housing 3. In this manner, the pair of male terminals 8 (see FIG. 9) are separated from the pair of female terminals 31 (see FIG. 9) completely. Incidentally, the fitting detection male connector 23 is separated from the fitting detection female connector 46 before the pair of male terminals 8 are separated from the pair of female terminals 31. In this manner, through the signal circuit, an external computer (not shown) detects that the fitting detection male connector 23 has been separated from the fitting detection female connector 46. In this manner, the power supply circuit is interrupted. As a result, when the lever-including housing 2 is removed from the power supply circuit-side housing 3, sparks can be prevented from being generated between the pair of male terminals 8 and the pair of female terminals 31.

According to the service plug 1 in the Example, as described above with reference to FIGS. 1 to 9, the interlinking plates 20 are piled up on one another. Due to the configuration, the number of the interlinking plates 20 can be increased/decreased even when the current-carrying capacity of the connection terminal part 49 changes. Thus, the current-carrying capacity of the connection terminal part 49 can be changed easily.

Further, according to the service plug 1 in the Example, the bolt fastening holes 21 are formed in each interlinking plate 20 formed into a thin plate shape. Due to the configuration, the bolt fastening holes 21 can be formed easily as through holes formed in the thin plate-like interlinking plate 20. In addition, the head parts 26 of the male terminals 8 function as fastening parts for fastening the interlinking plate 20 to the male terminals 8. It is possible to form the interlinking part 9 in which the male terminals 8 are connected to each other when the interlinking plates 20 are attached to the upper surfaces 27 of the head parts 26.

Accordingly, one interlinking plate 20 or a plurality of interlinking plates 20 can be fastened to one pair of male terminals 8 by the bolts 10 so that the connection terminal part 49 can be configured easily. Thus, there is attained an effect that workability during assembling is improved.

In addition thereto, it is a matter of course that the invention can be changed and carried out variously without changing the gist of the invention.

Although the invention has been described in detail and with reference to a specific embodiment, it is obvious to those skilled in the art that various changes or modifications can be made on the invention without departing from the spirit and scope of the invention.

The present application is based on a Japanese patent application (Patent Application No. 2014-10953) filed on Jan. 24, 2014, the contents of which are incorporated herein by reference.

INDUSTRIAL APPLICABILITY

According to the invention, a plurality of interlinking plates are piled up on one another. Due to the configuration, there is attained an effect that current-carrying capacity of the connection terminal part can be changed easily by an increase/decrease of the number of the interlinking plates. The invention attaining the effect is useful for a service plug which performs interruption of a power supply circuit.

REFERENCE SIGNS LIST

1 . . . service plug, 2 . . . lever-including housing, 3 . . . power supply circuit-side housing, 4 . . . lever, 5 . . . cover, 6, 30 . . . packing, 7, 28 . . . housing body, 8 . . . male terminals (one pair of terminals), 9, 9' . . . interlinking part, 10, 44 . . . bolt, 11 . . . fitting detection male terminal, 12 . . . arm part, 13 . . . gripping part, 14 . . . rotary shaft hole, 15 . . . cam hole, 16 . . . lever-side engagement part, 17 . . . rotary shaft, 18 . . . cover-side engagement part, 19, 45 . . . bolt threaded hole, 20 (20*a*, 20*b*, 20*c*) . . . interlinking plate, 21 . . . bolt fastening hole, 22 . . . male terminal receiving chamber, 23 . . . fitting detection male connector, 24 . . . fitting detection male terminal receiving part, 25 . . . shaft part, 26 . . . head part (fastening part), 27 . . .

upper surface, 29 . . . collar, 31 . . . female terminal, 32 . . . contact member, 33 . . . peripheral wall, 34 . . . attachment part, 35 . . . female terminal receiving chamber, 36 . . . cam shaft, 37 . . . opening portion, 38 . . . through hole, 39 . . . female terminal receiving chamber, 40 . . . male terminal inserting hole, 41 . . . female terminal inserting hole, 42 . . . electric contact part, 43 . . . electric connection part, 46 . . . fitting detection female connector, 47 . . . bus bar, 48 . . . fitting detection female connector inserting hole, 49 . . . connection terminal part

The invention claimed is:

1. A service plug for interrupting a power supply circuit by removing a connection terminal part from the power supply circuit, the service plug comprising:

a housing body having an open end and a terminal chamber receiving the connection terminal part through the open end;

a cover fitted to the housing body such that the cover covers the open end and abuts the connection terminal part;

wherein the connection terminal part comprises a pair of terminals and an interlinking part, wherein the pair of terminals are disposed to be spaced at a predetermined distance therebetween;

wherein the interlinking part that is formed so as match with the distance between the pair of terminals to interlink the terminals to each other;

wherein the interlinking part is formed from one interlinking plate or a plurality of interlinking plates each shaped into a thin plate; and wherein the interlinking plate or the interlinking plates are attached to the connection terminal part removably.

2. The service plug according to claim 1, wherein the one interlinking plate or the plurality of interlinking plates are attached to the pair of terminals removably.

3. The service plug according to claim 2, wherein bolt fastening holes for inserting bolts therein are formed in the interlinking plate or each of the interlinking plates; and wherein fastening parts for fastening the interlinking plate or the interlinking plates are formed in the pair of terminals.

* * * * *